US006854166B2

(12) United States Patent
Mohammadi

(10) Patent No.: US 6,854,166 B2
(45) Date of Patent: Feb. 15, 2005

(54) INSULATIVE NON-WOVEN FABRIC AND METHOD FOR FORMING SAME

(75) Inventor: Massoud Mohammadi, Raleigh, NC (US)

(73) Assignee: Atlantic Integrated Technologies, Raleigh, NC (US)

( * ) Notice: Subject to any disclaimer, the term of this patent is extended or adjusted under 35 U.S.C. 154(b) by 204 days.

(21) Appl. No.: 10/141,593

(22) Filed: May 8, 2002

(65) Prior Publication Data

US 2003/0208891 A1 Nov. 13, 2003

(51) Int. Cl.[7] ..... D04H 1/44
(52) U.S. Cl. ..... 28/103; 28/107
(58) Field of Search ..... 28/107, 109, 112, 28/110, 111, 113, 108, 114, 103, 104, 101, 102, 165, 166, 218, 220, 282; 19/0.3, 0.48, 0.56, 98, 113; 65/17.1, 17.3, 62, 376, 406

(56) References Cited

U.S. PATENT DOCUMENTS 2,949,645 A * 8/1960 Noda ..... 19/105
3,338,777 A * 8/1967 Irwin et al. ..... 442/355
3,641,638 A * 2/1972 Laible ..... 28/112
3,664,909 A * 5/1972 Ackley ..... 442/388
3,879,820 A * 4/1975 Grieves et al. ..... 28/110
4,107,374 A * 8/1978 Kusunose et al. ..... 442/400
4,237,180 A * 12/1980 Jaskowski ..... 442/324
4,476,186 A * 10/1984 Kato et al. ..... 442/60
4,847,140 A * 7/1989 Jaskowski ..... 428/220
6,151,763 A * 11/2000 Kruszewski ..... 28/107
6,517,938 B1 * 2/2003 Andoh et al. ..... 428/395

OTHER PUBLICATIONS

"Textile Terms and Definitions", Compiled by The Textile Institute Textile Terms and Definitions Committee, Published by The Textile Institute 2002, 11$^{th}$ Edition, p. 151.*

* cited by examiner

*Primary Examiner*—A. Vanatta
(74) *Attorney, Agent, or Firm*—Myers Bigel Sibley & Sajovec

(57) ABSTRACT

Insulative fabrics include a plurality of web layers. Each of the web layers comprises monostaple fibers having a length between about 0.5 and 2 inches. The plurality of web layers is positioned in overlying relationship and interconnected to each other (often through needle punching). In this configuration, the insulative non-woven fabric can provide a relatively low cost material with low thermal conductivity.

13 Claims, 5 Drawing Sheets

INSULATIVE NON-WOVEN FABRIC AND METHOD FOR FORMING SAME

FIELD OF THE INVENTION

The present invention relates generally to insulative materials, and more particularly to nonhazardous insulative materials.

BACKGROUND OF THE INVENTION

A heat barrier or insulator may be defined as any material which will impede the transfer of heat with reasonable effectiveness under normal conditions. Obviously, there are many processes and applications where elevated temperatures are either required or generated. When high temperatures are required, a substantial amount of energy is needed to produce the desired temperatures; a portion of this energy is lost from the process as heat escaping to the surrounding media. This energy loss may be reduced by successfully reducing the amount of heat escaping or by reducing the rate of escape. Doing so may provide for more efficient use of energy and reduce heat consumption levels.

Further, when high temperatures are generated within a device or apparatus and heat escapes, the environment in surrounding areas often are very uncomfortable. Excessive heat can be both a health risk and a deterrent to household and employee efficiency. Efforts to control hot environments often require large amounts of energy for cooling systems and fans. Thus, if such excess heat could be blocked, living and working conditions may be improved, and energy consumption may decrease.

Elevated temperature stability of non-woven fabrics is often associated with flame resistance and/or heat resistance). Thermal properties of materials have been studied for many years, and much of the existing work has been associated with the development and properties of heat resistant fibers such as Kevlar, Nomex, Novolid, PBI (polybenzimidazole), carbon, glass, ceramic, or other fibers. These fibers can be processed into woven fabrics or otherwise manufactured into non-wovennon-woven fabrics or blankets, which are then used in high heat environments to thermally insulate desired areas. Exemplary applications for heat-resistant fabrics include (a) fire blocking materials in aircraft, coach and train seats, (b) heat-resistant gloves, (c) slip sheets for roofs and decks, (d) fire-resistant linings and insulative padding in the automobiles, aircraft, and aerospace vehicles, and (e) furnace linings.

Because of the nature of the environments in which these materials are typically used, performance factors such as weight, thickness, volume, thermal conductivity, and expense can often limit the use of the materials. In addition, some of these materials can be hazardous in certain environments, and, as such, they must be covered (typically with a coating or the like) in order to be used.

In addition to the shortcomings set forth above, non-woven fabrics, such as those formed of glass or ceramic fibers, may raise additional issues. For example, such fabrics are typically formed in a one-step melt blowing process, in which a stream of short "staple" fibers is propelled onto a collector screen. The resulting product is typically non-uniform in thickness and fiber distribution, with the result that a relatively thick sample of material may be required in order to ensure desired thermal conductivity. Also, multi-filament glass fibers or filament yarns are typically extruded and cut into bundles of staple fibers. These are are relatively brittle; as a result, they are difficult to "card" (i.e., separate from each other), as breakage is high, as is jamming of the fibers due to static electricity (even when the fibers are sprayed with an antistatic liquid). Moreover, some of these materials are bonded with compositions that emit toxic fumes, particularly at high temperatures.

In view of the foregoing, it would be desirable to provide a thermally insulative material that can improve one or more of the listed performance factors and/or address one or more of the listed shortcomings of insulative non-woven fabrics.

SUMMARY OF THE INVENTION

The present invention is directed to insulative non-woven fabrics that can provide improved insulative properties and methods for forming such fabrics. The insulative fabrics of the present invention comprise a plurality of web layers. Each of the web layers comprises monostaple fibers having a typical length of between about 0.5 and 2 inches, although this length may vary to suit a particular application. The plurality of web layers is positioned in overlying relationship and interconnected to each other (often through needle punching). In this configuration, the insulative non-woven fabric can provide a relatively flexible, light, low thickness, low cost material with low thermal conductivity.

Insulative non-woven fabrics can be formed through an inventive method that comprises as a first step providing a plurality of staple fiber bundles. The staple fiber bundles are converted to monostaple fibers (typically in a carding operation). The monostaple fibers are then formed into a web layer. An overlying stack of these web layers is then interconnected (preferably by needle punching, as described above, or by another bonding process) to form an insulative non-woven fabric.

DETAILED DESCRIPTION OF THE INVENTION

Figure 1:
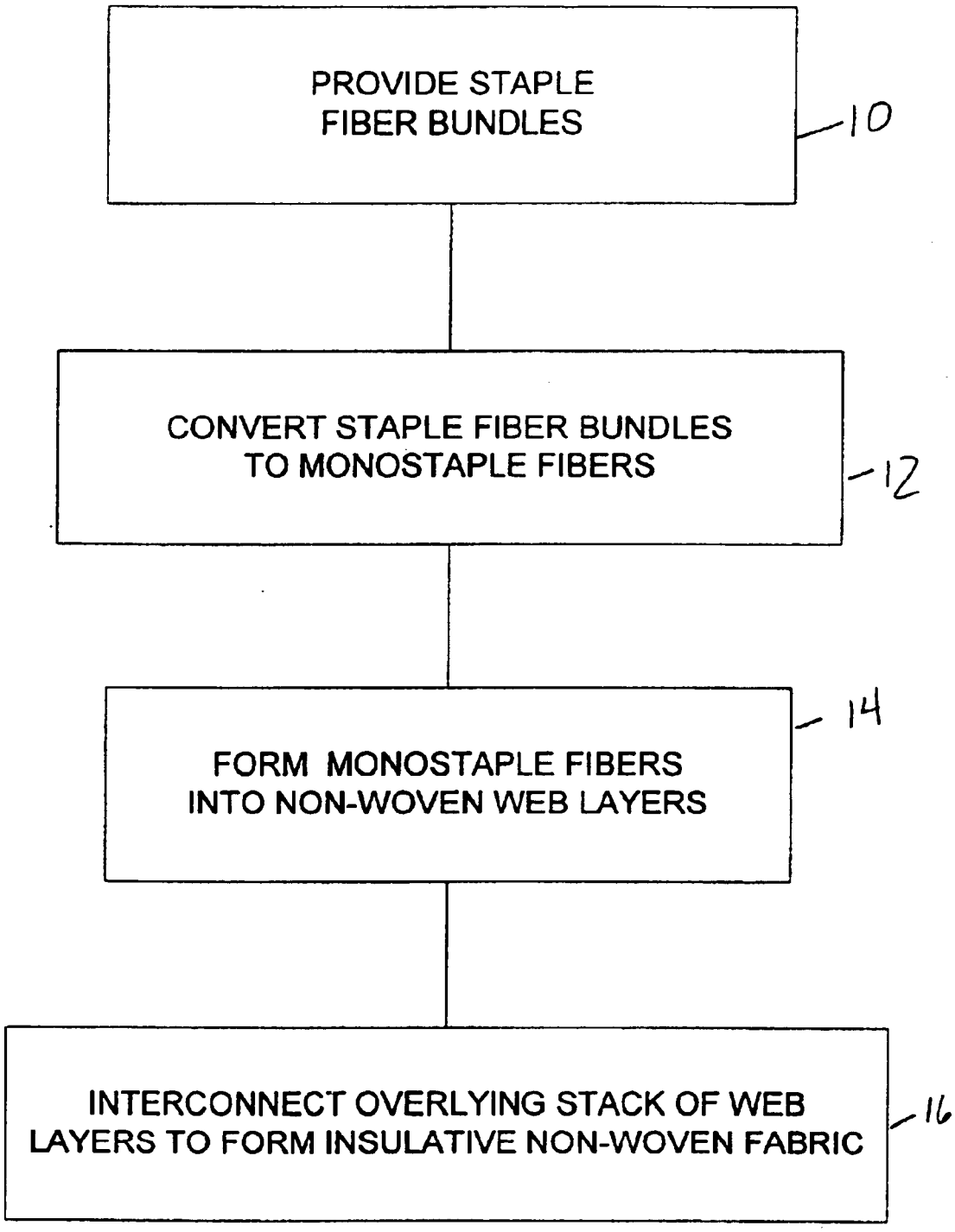
FIG. 1 is a flow chart illustrating a method for forming an insulative composition according to the present invention.

The present invention will now be described more fully hereinafter, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

Referring now to the drawings, a method for forming an insulative composition is illustrated in FIG. 1. As set forth in FIG. 1, the method is initiated with the provision of staple fiber bundles (Box 10). The staple fiber bundles are then converted into monostaple fibers (Box 12). The monostaple fibers are then formed into a web layer (Box 14). Multiple web layers of material are then arranged in a stack of overlying layers and interconnected (Box 16). These steps, as well as the materials and apparatus employed therein, are described in greater detail below.

The staple fiber bundles can be provided in virtually any form known to those skilled in this art. The staple fibers bundles typically include 100, 200 or even more individual fibers, each of which is between about 0.5 and 2 inches in length, and between about 9 and 12 microns in diameter, although the dimensions may be varied based on the application. They can be uncoated or coated. It is preferred that the staple fiber bundles be glass staple fiber bundles, and that the length of the typical fiber be between about 0.5 and 2 inches. Such fiber bundles are available from Owens Corning, Toledo, Ohio. Other exemplary fibers include Kevlar®, Nomex®, Novilid®, polybenzimidazole, carbon, ceramic and other fibers.

Figure 2:
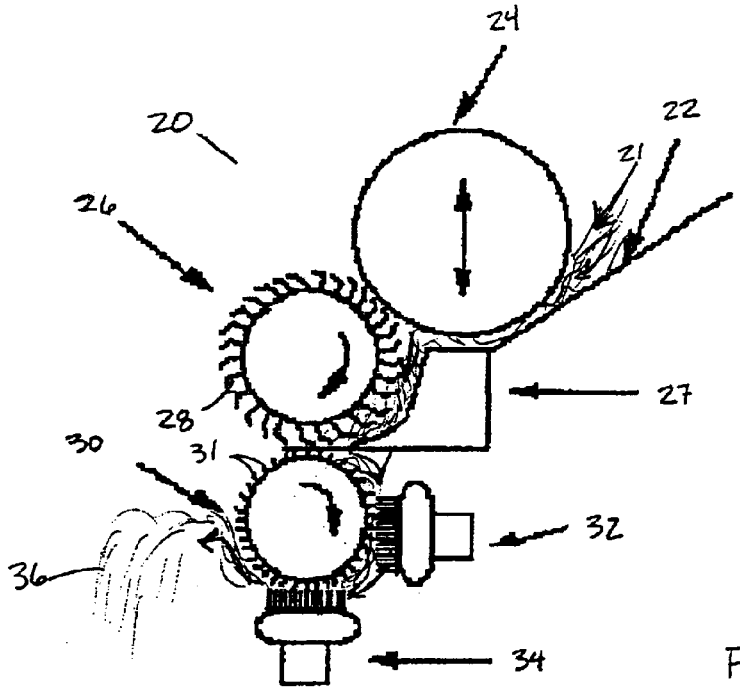
FIG. 2 is a schematic side view of a carding apparatus according to the present invention.

The staple fiber bundles are converted to monostaple fibers. As used herein, the term "monostaple fiber" is intended to encompass individual staple fibers, such as those that form staple fiber bundles; exemplary dimensions are provided above. The conversion of staple fiber bundles to monostaple fibers can be achieved, for example, with a carding apparatus such as that designated at 20 in FIG. 2. The carding apparatus 20 includes a sample input tray 22, a wad detecting roll 24 located above the exit of the sample input tray 22, a fillet wire feed roll 26 located below and downstream of the wad detecting roll 24 and adjacent a feed plate 27, a pinned, perforated cylinder 30 that is located below the fillet wire feed roll 26, and two carding flats 32, 34. The apparatus 20 is similar to devices used to card cotton and other natural fibers; however, because much of the staple fiber bundles used with the apparatus 20 will likely be man-made, some of the anti-contamination components of a typical cotton carding machine, such as microdust filters, lint boxes, and the like, can, optionally, be omitted from the carding apparatus 20. An exemplary carding apparatus is a modified version of a microdust and trash monitor (MTM) available from Zellweger Uster, Charlotte, N.C.

In operation, staple fiber bundles (designated in FIG. 2 at 21) are fed onto the sample tray 22. Staple fiber bundles 21 travel through the gap between the sample tray 22 and the wad detecting roll 24; the gap is sized to impede the progress of wads or bunches of staple fiber bundles larger than a certain size. The staple fiber bundles 21 are then fed between the fillet wire feed roll 26 and the feed plate 27 as the fillet wire feed roll 26 rotates in a direction that draws the fibers away from the wad detecting roll 24 (clockwise from the vantage point of FIG. 2). The wire fingers 28 of the wire feed roll 26 feed the staple fiber bundles 21 into engagement with the pinned, perforated cylinder 30, causing them to separate somewhat from one another (this process is often termed "opening" the fiber). Two different cleaning mechanisms assist in the opening of the fibers: first, microdust may be released from the fibers by the combing action of the pins and separated from the fibers by air drawn into the pinned, perforated cylinder 30; second, impact combing and initial forces between the wire feed roll 26 and the pinned, perforated cylinder 30 can remove dust and trash particles. The partially-opened staple fiber bundles 21 then travel onto the pinned, perforated cylinder 30, which includes a number of radially extending pins 31 that capture bundles 21. The pinned, perforated cylinder 30 rotates in the rotative direction opposite that of the wire feed roll 26 (counterclockwise from the vantage point of FIG. 2). The pinned, perforated cylinder 30 conveys the staple fiber bundles 21 into contact with the carding flats 32, 34, which are located at 90 degree circumferential intervals from each other about the pinned, perforated cylinder 30. The carding flats 32, 34 continue to separate the staple fiber bundles 21 from each other until they emerge from the carding flat 34 as monostaple fibers 36. As noted above, the monostaple fibers typically have a length of between about 0.5 and 2 inches (preferably about 1.5 inches) and a diameter of between about 9 and 12 microns, although the apparatus 20 may be configured for use with different fibers lengths or diameters.

Those skilled in this art will recognize that other techniques and apparatus that can convert staple fiber bundles into monostaple fibers may be suitable for use with the present invention. Notably, the conversion to monostaple fibers typically renders the resultant fibers far more flexible than their staple fiber bundle counterparts. It should also be recognized that the monostaple fibers may be obtained by separating fibers that form chopped multifilament.

Figure 3:
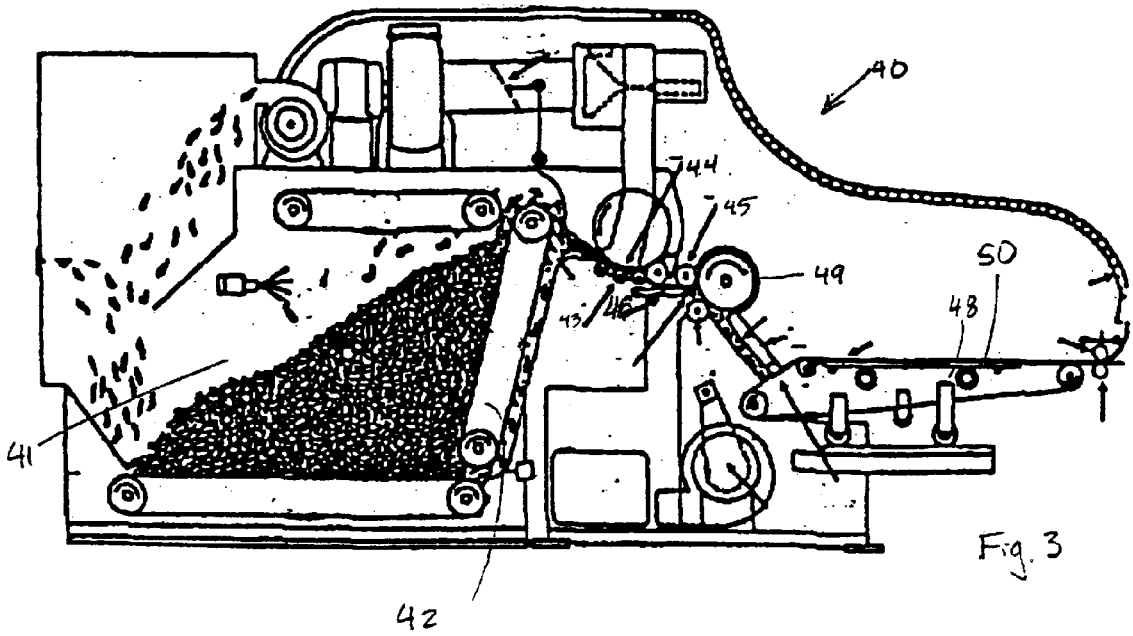
FIG. 3 is a schematic side view of a webbing apparatus according to the present invention.

After conversion of the staple fiber bundles to monostaple fibers, the monostaple fibers are then formed into a web layer. This process can be carried out on webbing apparatus such as that illustrated in FIG. 3 and designated therein at 40. The webbing apparatus 40 includes an input hopper 41 that receives and stores monofilament fiber formed in the carding apparatus 20. An elevating conveyer 42 conveys the fibers onto a roller conveyor 43, which conveys the fibers past a condenser screen 44. A feed roll 45 and feed plate 46 then feed the fibers under a lickerin 49 that is mated with the feed roll 45 and a saber 47. The monostaple fibers are formed into a web layer 50 and conveyed away with a conveyor 48. The web layer 50 is typically about 0.5 cm in thickness, but may be any thickness as desired for a particular application.

Those skilled in this art will appreciate that other apparatus for forming monostaple fibers into a web layer may also be suitable for use with the present invention. For example, a regular or flat carding apparatus (for short or long staple fibers) or air, wet or dry lay web precipitation process may be used. An exemplary webbing apparatus is a Rando Webber® machine, available from Rando Machine Corporation, Macedon, N.Y.

Figure 3A:
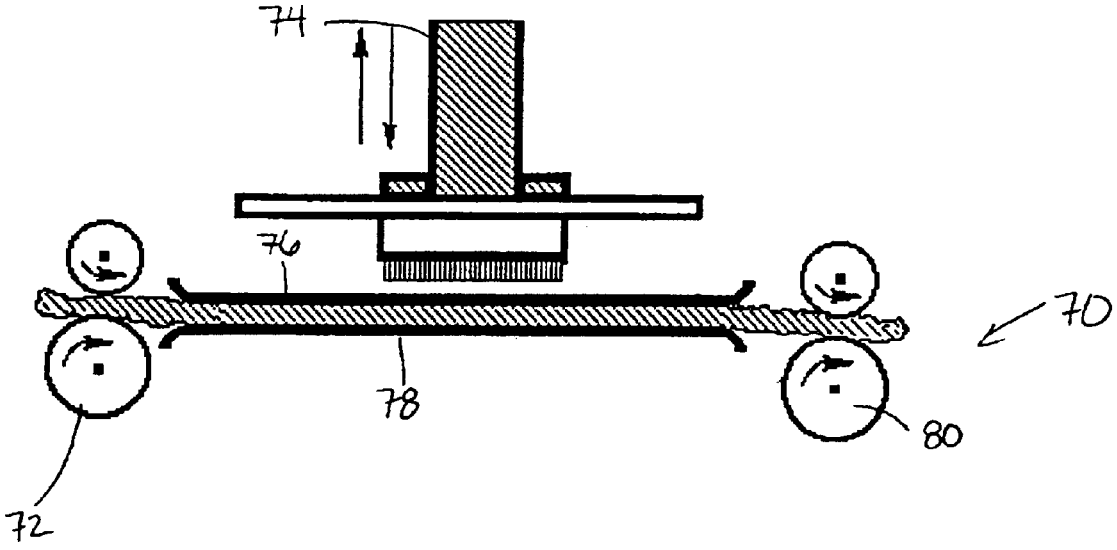
FIG. 3A is a schematic side view of a needle punching machine that can be employed with the present invention.
Figure 4:
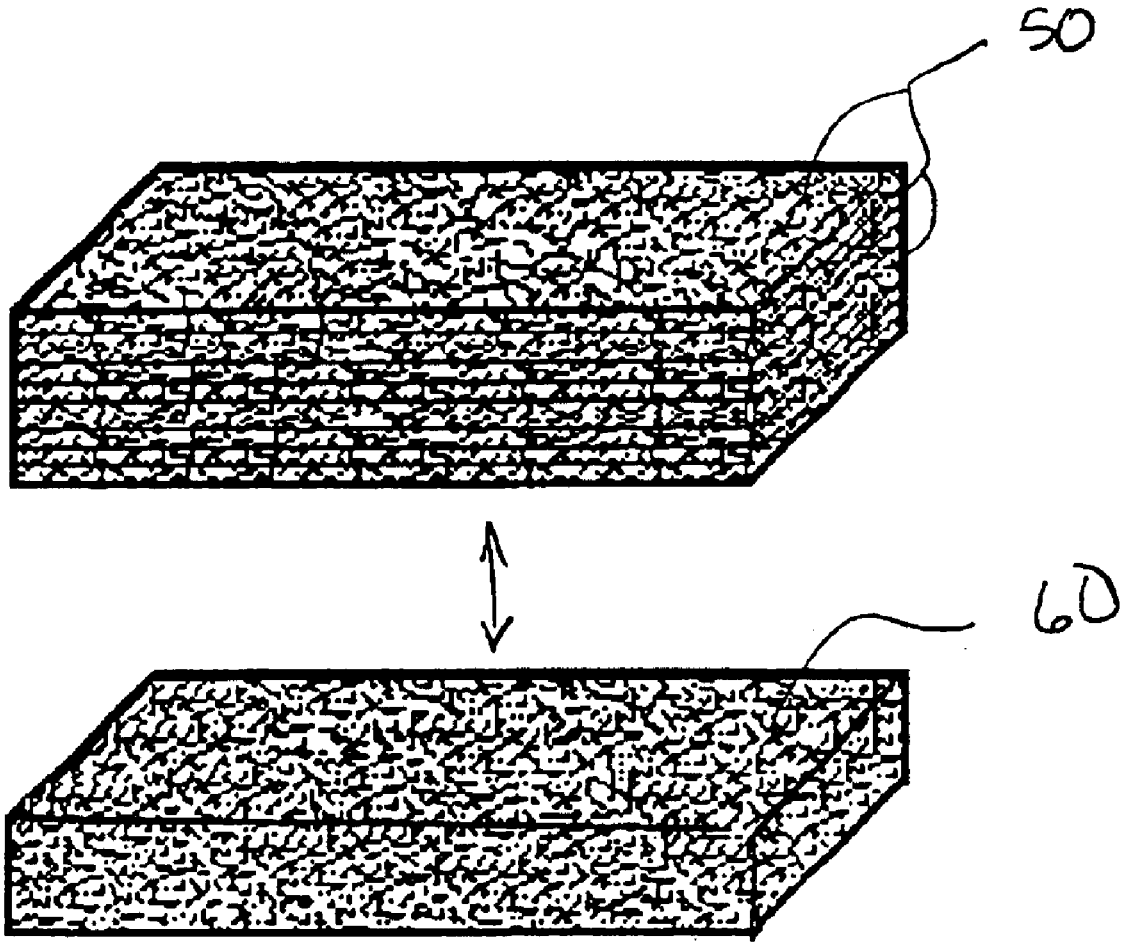
FIG. 4 is a cutaway perspective view of a section of insulative non-woven fabric according to the present invention.

Once the monostaple fibers have been formed into the web layer 50, multiple web layers can be overlaid and formed into an insulative non-woven fabric 60 (see FIG. 4). The web layers 50 can be interconnected in any manner known to those skilled in this art for the interconnection of overlying web layers; preferably, the web layers 50 are interconnected through a typical needle punching process. An exemplary needle punching machine 70 is illustrated in FIG. 3A. The machine 70 includes a web feeding mechanism 72, a needle beam 74 with a needleboard and needles, a stripper plate 76, a bed plate 78, and a fabric take-up mechanism 80. The fiber web (sometimes carried or reinforced by a scrim or other fabric) is guided between the metal bed and stripper plates 78, 76, which have openings corresponding to the arrangement of needles in the needleboard. During the downstroke of the needle beam 74, each barb carries groups of fibers, corresponding in number to number of needles and number of barbs (up to 36) per needle, into subsequent web layers a distance corresponding to the penetration depth. During the upstroke of the needle beam 74, the fibers are released from the barbs and interlocking is established. At the end of the upstroke, the fabric is advanced by the take-up mechanism 80 and the cycle is repeated. Needle density is typically determined by the distance advanced and the number of penetrations per stroke.

It is preferred that the needles used have between one and three barbs (although 6, 9 or even more barbs may be used depending on the application), and that the needle not penetrate completely through the layers of webs, but instead penetrate to a depth within about one or two millimeters of the underlying surface of the lowermost web layer 50. It is theorized that avoiding full penetration of the needles can reduce the probability of the connecting of pores from one surface of the non-woven fabric 60 to the other.

The finished non-woven fabric 60 is typically between 0.25 and 2 inches in thickness and includes between about 4 and 10 web layers 50, although the number of web layers 50 and the thickness of the non-woven fabric 60 may vary.

In this configuration, the insulative non-woven fabric 60 can have superior insulating properties. For example, a composition of glass monostaple fibers (density of 2.54 g/cm$^3$) having a thickness of 16.7 mm can have a thermal conductivity of 0.0596 W/m° C. at a temperature of 267° C., which compares very favorably with that of an equivalent thickness of ceramic or air. As such, it can be provided in lesser thicknesses than conventional insulation formed of glass fibers. It does not typically require a covering to render it nonhazardous and it can be quite flexible, which can enable it to be used in many environments. In some embodiments, a similar procedure may be used for other fibers, such as ceramic, to make a non-woven sample for usage in environments up to 1,500° C.

Those skilled in this art will appreciate that the insulative compositions of the present invention may include solely layers of webs of mono staple fibers, or may include additional layers (such as ceramic, aluminum, KEVLAR, and the like) sandwiched between, overlying or underlying one or more web layers. These layers or any additional layers may be bonded thermally, mechanically, chemically, or by some other process to each other. As such, the web layers may comprise a portion of a composite material. In addition, they may be combined with different resins to form composite materials.

Although a primary use of the inventive compositions is for thermal insulation and/or sound absorption for residential and commercial buildings, other potential applications include other insulated items, such as sleeping bags, camping gear, sporting apparel, automotive and public transportation upholstery, piping, packing, ovens and furnaces, protective apparel for firefighters and other emergency personnel, and the like. For some elevated temperature applications, such as commercial aircraft or aerospace re-entry vehicles, ceramic or other high temperature monostaple fibers are preferred.

The invention will now be described in greater detail in the following non-limiting examples.

EXAMPLE 1

Sample Preparation

Insulative non-woven fabric samples were prepared for thermal conductivity testing in the following manner. Glass staple fiber bundles were obtained from Owens Corning. The individual fibers making up the bundles were 1.5 inches in length and between about 9 and 12 microns in diameter.

The glass staple fiber bundles were converted to monostaple fibers using an MTM carding apparatus (available from Zellweger Uster, Charlotte, N.C.). The monostaple fibers were then fed into a Rando Webber® webbing device (available from Rando Machine Corporation, Macedon, N.Y.) and formed into individual web layers 0.5 cm in thickness. Seven web layers were then overlaid and needle punched together into a fabric using a needling machine (available from James Hunter). A total 575 of needles were placed on the board which had an area of 33 cm×26 cm. The speed of the machine was 114 stroke per minute; the needles were specified as item #605331 (15×18×42×3 S 111 G 2027), and were set to penetrate the layered webs to a depth of between about 1 and 2 mm of the lower surface. Non-woven fabric samples 16.7 mm thick were produced. The non-woven fabric samples were cut into 8 inch diameter disks (weight approximately 20.7 g) and tested for thermal conductivity.

EXAMPLE 2

Thermal Conductivity Testing of Samples

The samples prepared in Example 1 were tested for thermal conductivity using a Guard Hot Plate (Model No. GHP-200, available from Holometrix, Bedford, Mass.). The samples were located on either side of a main/guard heater assembly. Heat flowed from the main/guard heater assembly, through the two test samples in the direction of adjacent heatsinks. Auxiliary heaters were placed between the sample and the heat sinks to control the temperature of the sample surface. The auxiliary heaters are often referred to as the "cold side" heaters as they control the cold side surface temperature of the samples, the "hot side" of the samples being the surface adjacent to the main/guard heater assembly. See Guard Hot Plate Instrument (*Model GHP*-200), Holometrix, Bedford, Mass. for more information regarding the testing device.

In order to determine the apparent thermal conductivity of the sample, the temperature differences between the opposed surfaces of the samples were measured at 30 minute intervals. The results are shown in Table 1.

TABLE 1

| Time (minutes) | Heater Temperature (° C.) | Far Surface Temperature (° C.) | Applied Temperature (° C.) |
|---|---|---|---|
| 0 | 15 | 23 | 23 |
| 30 | 30 | 25 | 62 |
| 60 | 45 | 28 | 94 |
| 90 | 60 | 33 | 122 |
| 120 | 75 | 38 | 147 |
| 150 | 90 | 43 | 168 |
| 180 | 105 | 48 | 186 |
| 210 | 120 | 53 | 202 |
| 240 | 135 | 58 | 215 |
| 270 | 150 | 63 | 226 |
| 300 | 165 | 67 | 235 |
| 330 | 180 | 70 | 244 |
| 360 | 195 | 73 | 249 |
| 390 | 210 | 76 | 256 |
| 420 | 225 | 78 | 261 |
| 450 | 240 | 80 | 264 |
| 480 | 255 | 82 | 266 |
| 510 | 270 | 83 | 267 |

Figure 5:
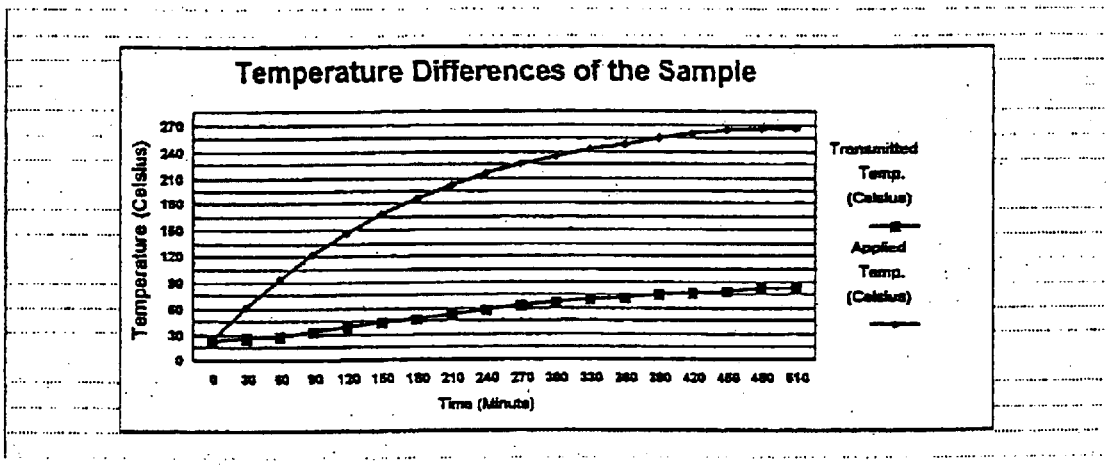
FIG. 5 is a graph plotting applied and transmitted temperature as a function of time.

As Table 1 indicates, the testing was carried out for more than 8.5 hours. At an applied near surface temperature of 267° C., the far surface temperature was 83° C. at a steady state (these results are also shown in FIG. 5). The testing was halted at 267° C. because at this stage the back side of the temperature remained constant, indicating that a steady state point had been reached.

EXAMPLE 3

Calculation of Thermal Conductivity

The thermal conductivity of the samples was determined by using the temperature differences of the samples shown in Table 1 above. The effective thermal conductivity of the samples was determined by the following equations:

$$K_{ef}=EI/S\{1/[(\Delta T/L)_1+(\Delta T/L)_2]\} \quad (1)$$

$$Q=N(EI) \quad (2)$$

wherein $K_{ef}$=effective thermal conductivity (W/m° C.),

S=main heater surface area (0.00835 $m^2$),

L=thickness of the sample (0.0167 m),

ΔT=temperature gradient (° C.)

E=voltage reading at switch position 22 (1 mV=1 Volt),

I=current reading at switch position 23 (1 mV=0.1 Amp),

Q=main heater input power (W), and

N=power correction factor (determined experimentally by Holometrix to account for small systematic errors in the power measurement).

From Equations (1) and (2), and having information regarding the thickness and temperature differences of the samples, the apparent thermal conductivity of the sample becomes 0.0596 W/m° C. for a surface area of the sample of 0.00835 $m^2$ and a mean temperature for the samples was 155° C. As is shown, the thermal conductivity of the sample is very close to the thermal conductivity of air (or of ceramic material with the same packing density).

The results show the thermal conductivity of this sample is very close to the air, or ceramic material made with the same packing density, fiber size, and fiber density. In this configuration, at higher temperatures the mode of radiation can have an important role in the heat transfer to the sample. Because of the color and the size of the pores and fiber size, the mode of radiation may initiate more scattering forward and backward in the sample and cause a delayed heat transfer to the sample, resulting in a lower thermal conductivity than other glass non-woven samples with the same thickness and weight now available in the market.

It is believed that the material can be tested up to 500° C. without significantly changing its properties.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

What is claimed is:

1. A method of manufacturing an insulative non-woven fabric, comprising:

(a) providing a plurality of staple fiber bundles;

(b) converting the staple fiber bundles to monostaple fibers;

(c) forming the monostaple fibers into a web layer;

(d) repeating steps (a) through (c) to form a plurality of web layers; and (e) interconnecting an overlying stack of web layers to form an insulative non-woven fabric.

2. The method defined in claim 1, wherein the staple fiber bundles are glass staple fiber bundles.

3. The method defined in claim 1, wherein converting the staple fiber bundles to monostaple fibers comprises carding the staple fiber bundles.

4. The method defined in claim 3, wherein carding the staple fiber bundles comprises passing the staple fiber bundles across a first carding flat and passing the staple fiber bundles across a second carding flat.

5. The method defined in claim 1, wherein interconnecting an overlying stack of web layers comprises needle punching an overlying stack of web layers.

6. The method defined in claim 2, wherein the glass staple fiber bundles have a fiber length of between about 0.5 and 2 inches.

7. The method defined in claim 2, wherein the glass staple fiber bundles have a fiber diameter of between about 9 and 12 microns.

8. The method defined in claim 1, wherein the insulative non-woven fabric formed by interconnection of the web layers is between about 0.5 and 2 inches in thickness.

9. The method defined in claim 1, wherein the insulative non-woven fabric formed by interconnection of the web layers includes between about 4 and 10 web layers.

10. The method defined in claim 1, wherein the insulative non-woven fabric formed by interconnection of the web layers includes no intermediate layers between adjacent layers of web layers.

11. A method manufacturing an insulative non-woven fabric, comprising:

(a) providing a plurality of glass staple fiber bundles;

(b) carding the glass staple fiber bundles to form monostaple glass fibers;

(c) forming the monostaple glass fibers into a web layer;

(d) repeating steps (a) through (c) to form a plurality of web layers; and (e) needle punching an overlying stack of web layers to form an insulative non-woven fabric.

12. The method defined in claim 11, wherein the glass staple fiber bundles have a fiber thickness of between about 9 and 12 microns.

13. The method defined in claim 11 wherein the insulative non-woven fabric formed by needle punching of the web layers is between about 0.5 and 2 inches in thickness.

* * * * *